US006238205B1

(12) United States Patent
Svedlund

(10) Patent No.: US 6,238,205 B1
(45) Date of Patent: May 29, 2001

(54) BURNER ASSEMBLY

(75) Inventor: Joel Svedlund, Johanneshov (SE)

(73) Assignee: Optimus International AB

( * ) Notice: Subject to any disclaimer, the term of this patent is extended or adjusted under 35 U.S.C. 154(b) by 0 days.

(21) Appl. No.: 09/570,505

(22) Filed: May 13, 2000

(51) Int. Cl.[7] ..... F23B 11/04

(52) U.S. Cl. ..... 431/2; 431/123; 239/117; 126/38

(58) Field of Search ..... 431/2, 123; 126/38, 126/40; 137/244; 239/117, 114, 123; 134/8; 15/104.16

(56) References Cited

U.S. PATENT DOCUMENTS 2,206,006 * 6/1940 Hendrey ..... 15/220.2
2,344,758 * 3/1944 Welsh ..... 431/12
3,175,601 * 3/1965 Knapp et al. ..... 239/117
3,296,645 * 1/1967 Shore ..... 15/220.2
3,576,382 * 4/1971 Finnstrand ..... 431/209
3,600,737 * 8/1971 Shore ..... 15/220.2
3,751,750 * 8/1973 Kaftan ..... 15/220.2
3,839,085 * 10/1974 Hulvey et al. ..... 134/8
3,850,372 * 11/1974 Finnstrand ..... 431/344
4,482,244 * 11/1984 Yamazaki et al. ..... 15/1.51
4,977,637 * 12/1990 Demers ..... 15/220.2
5,044,555 * 9/1991 Youngeberg et al. ..... 239/117
5,458,294 * 10/1995 Zachary et al. ..... 530/80
5,513,624 * 5/1996 Vorhis ..... 431/123

* cited by examiner

*Primary Examiner*—Ira S. Lazarus
*Assistant Examiner*—David Lee
(74) *Attorney, Agent, or Firm*—John Lezdey & Assoc.

(57) ABSTRACT

There is provided a burner assembly for burning fuel in which the housing contains a nozzle orifice and a cleaning needle moveable into and out of the orifice. The needle is provided with permanent magnetic characteristics and is between a pair of movable magnets, which can be rotated to change poles so as to move the needle into and out of the orifice.

5 Claims, 7 Drawing Sheets

BURNER ASSEMBLY

FIELD OF THE INVENTION

This invention concerns a burner assembly to be used in lightweight portable or stationary stoves for different liquid and gaseous fuels.

DESCRIPTION OF THE RELATED ART

This type of stoves using liquid or gaseous fuels have clogging problems caused by building up of the fuel itself in the nozzle orifice, such as coke formation, or of extraneous material. Then there is a need for cleaning this orifice.

This type of burners usually have a cleaning needle inside the orifice, which needle could be brought to penetrate the orifice to clean the orifice and then retracted to clear the orifice. One known method to move the needle in and out of the orifice is by means of a pinion, engaging a rack provided on a burner body carrying the needle. The pinion is handled from the outside of the burner. Another known method is to use a weighted needle which upon shaking enters the orifice with an in and out motion. The drawback of the first method is that there is a need for very exact fit between rack and pinion and the assemblage is troublesome. The second method deals with a device, that is more simple to produce and assemble. However it is difficult to handle especially when burning and could not at all be used in connection with heavier or stationary stoves.

SUMMARY OF THE INVENTION

The present invention is directed to a burner assembly for burning of liquid or gaseous fuel of different types. The burner assembly has a cleaning needle which is possible to move in and out of the nozzle orifice by means of magnetic force. The invention could be used in connection with lightweight stoves, more heavy stoves or stationary stoves.

When moving a magnet provided outside a burner assembly housing the magnetic needle inside the housing will move correspondingly, which imply that by means of the outside, movable magnet it is possible to move the needle up and down in the housing and thereby in and out of the nozzle orifice.

The needle is suitably provided on a needle body which per se could be a magnet or which could be provided with a built in, separate magnet. The magnet outside the housing could be a permanent magnet or a magnet of electromagnetic type. In this case it would be possible to have this electromagnetic type magnet capable of producing opposite magnet fields by shifting the magnetic polarization.

DESCRIPTION OF THE PREFERRED EMBODIMENTS

Figure 1:
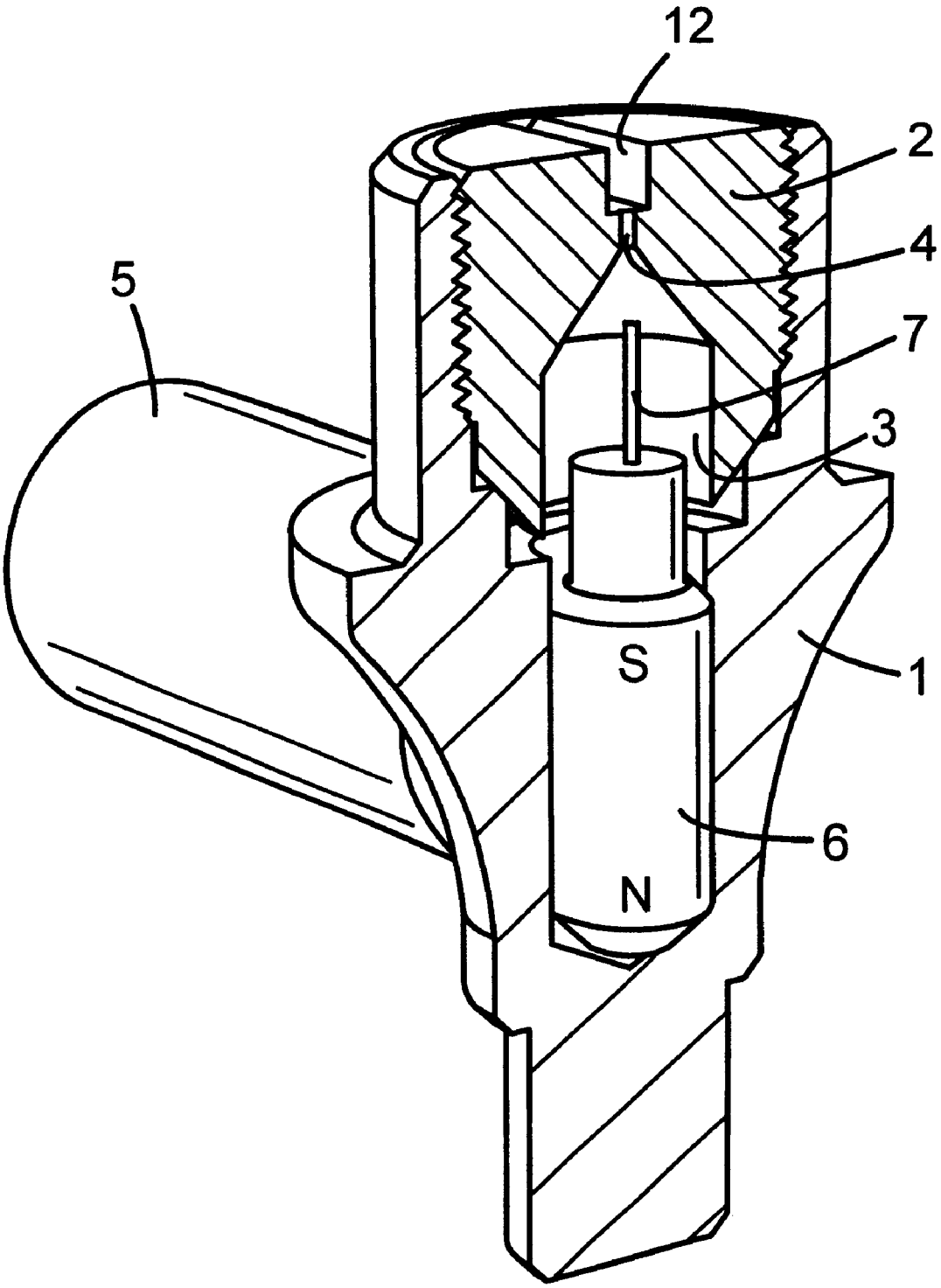
FIGS. 1 and 2 show schematically an isometric sectionally view of part of the invention in two positions respectively of the cleaning needle.

FIG. 1 shows schematically in cross section a burner without the outside provided magnet or magnets, together forming the burner assembly according to the invention.

The burner consists of a housing 1 and a nozzle section 2, attached to the housing 1 by means of threads. The housing 1 and the nozzle section 2 are enclosing a chamber 3 of cylindrical form, the upper end of which has a conical shape at the point forming a nozzle orifice 4. 5 depicts a part of a fuel line to be connected to the fuel delivery system, not shown. The chamber 3 is occupied by a cylindrical needle body 6 provided with a cleaning needle 7. The body 6 with the needle 7 is movable up and down in the chamber 3, FIG. 1 shows the needle retracted in the chamber, leaving the orifice 4 open.

According to the invention the needle body 6 is of magnetic material forming a permanent magnet. It is also possible to have the body made in a non-magnetic material, in which a permanent magnet 6' is incorporated, see FIG. 2, as an alternative. The poles of the body 6 as well as the magnet 6' are designated S and N respectively. The rest of the burner assembly is made of a non-magnetic material, not influencing the body 6, which have magnetical property.

In the example schematically shown in FIGS. 3–7 the burner according to FIG. 1 is forming a burner assembly including permanent magnets 8 and 9 provided upon a horizontally slidable device 10, as shown in the figures. The slidable device 10 could be mounted in the stove or in a separate tool. The poles of the magnets 8, 9 are designated N and S respectively.

Figure 3:
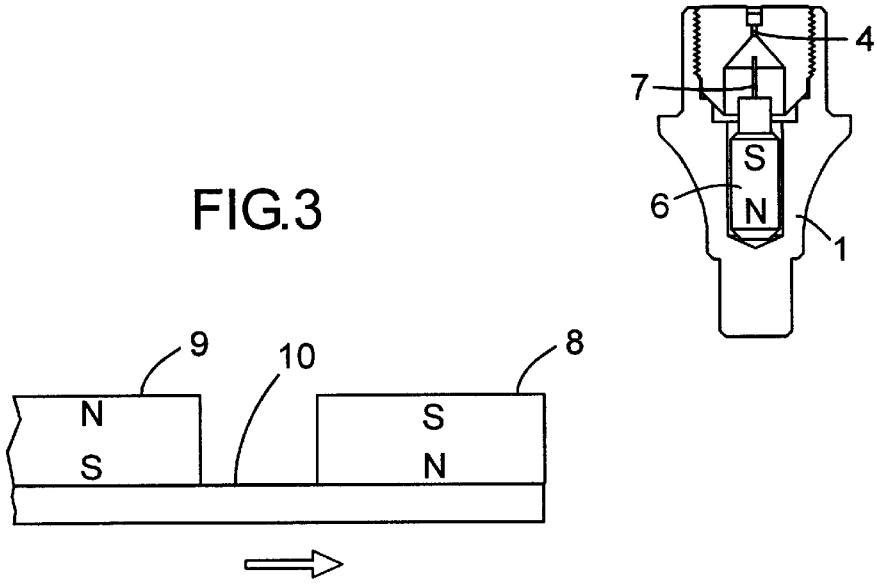
FIGS. 3–7 show schematically sequences of the operation of one preferable arrangement of the invention.

FIG. 3 shows the needle 7 retracted in the chamber 3, leaving the orifice 4 open. The body 6 with the needle 7 is not influenced by the magnets 8, 9 and the body 6 is kept in this position by the gravitation.

Figure 4:
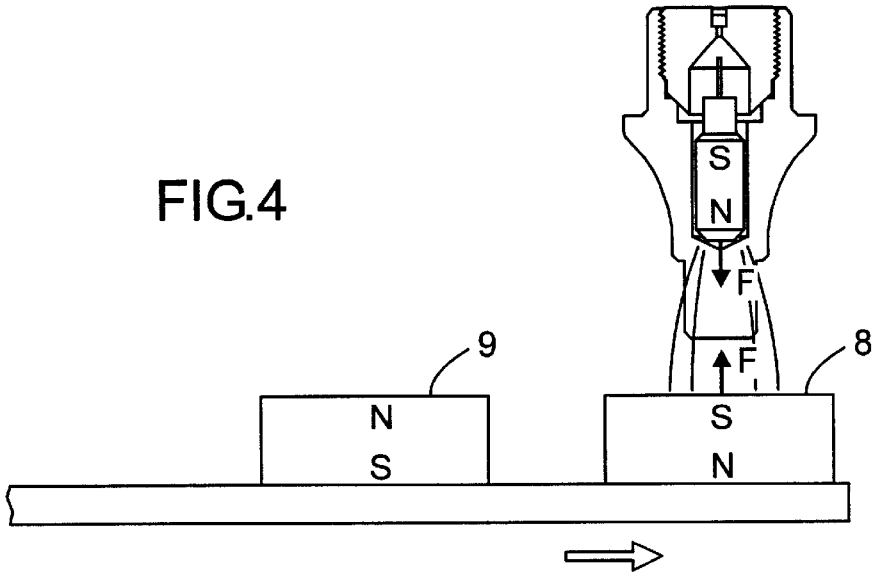
Figure 5:
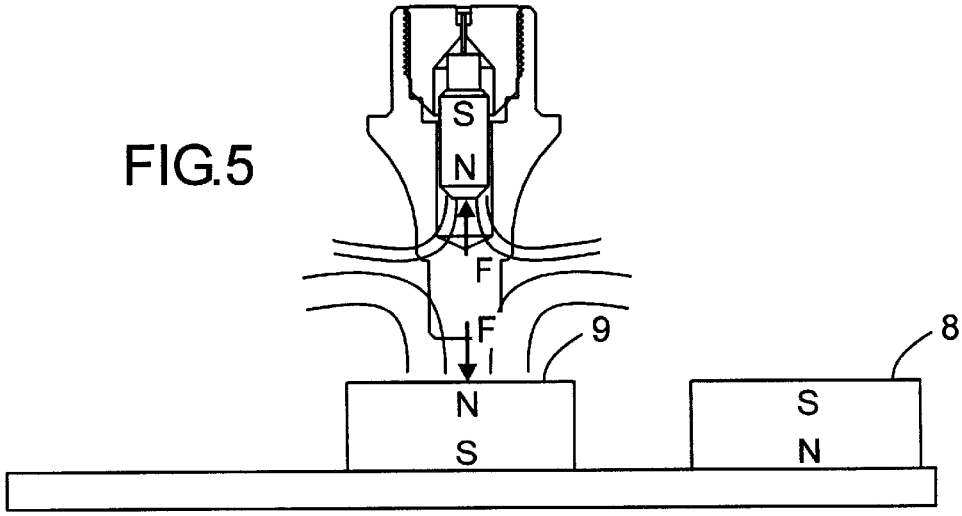

FIGS. 4 and 5 show how the magnets 8, 9 are displaced by means of the slidable device 10 beneath the burner 1. Firstly the magnet 8 is brought beneath the burner and the north pole N and south pole S of the body 6 and magnet 8 respectively attract each other (arrows F) . Further displacements of the device 10 will then bring the magnet 9 in a position beneath the burner 1 and its north pole N is placed beneath the north pole N of the body 6. This means that a repulse force F (FIG. 5) is created between the magnet 9 and the body 6, which inturn means that the body 6 is forced upwardly, whereby the needle 7 penetrates the orifice 4, which now is being cleaned.

Figure 6:
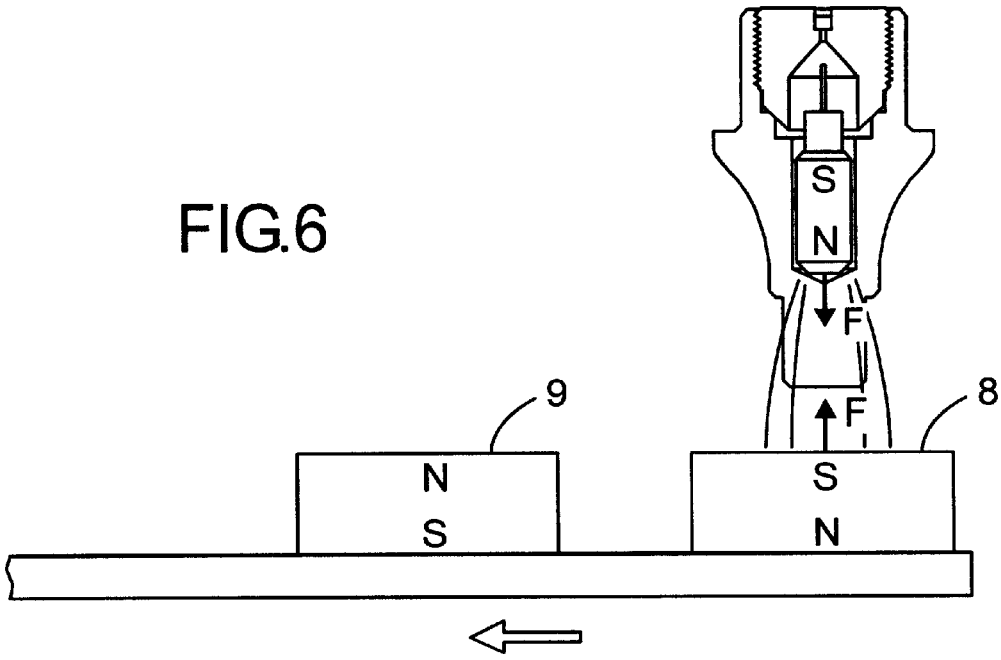

FIG. 6 shows how the device 10 with the magnets 8, 9 is retracted now again bringing the magnet 8 beneath the body 6 of the burner 1, which means that an attraction force is created, retracting the body downwards and the needle 7 out of the orifice 4, leaving this open and cleaned.

Figure 7:
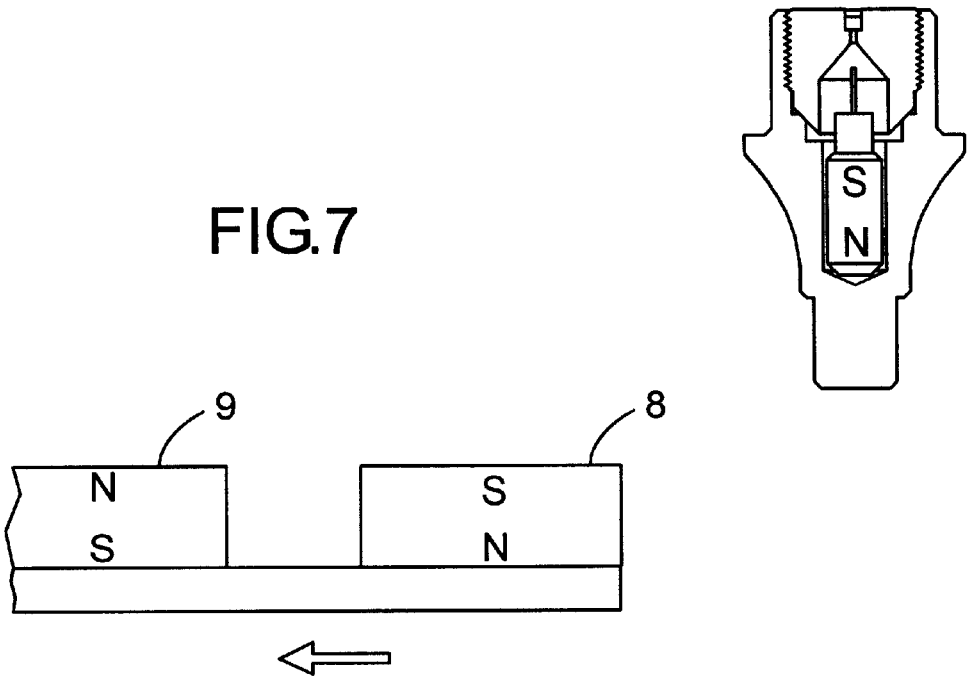

FIG. 7 shows how the device 10 has occupied its initially position with the magnets 8, 9 out of influence with the body 6, as shown in FIG. 3.

The use of the attraction force according to FIG. 6 is advantageous when the needle 7 is stuck in the orifice 4.

The manoeuvering of the slidable device 10 with the magnets 8 and 9 could be done in several ways using no inventive steps and obvious for the man skilled in the art.

Figure 8:
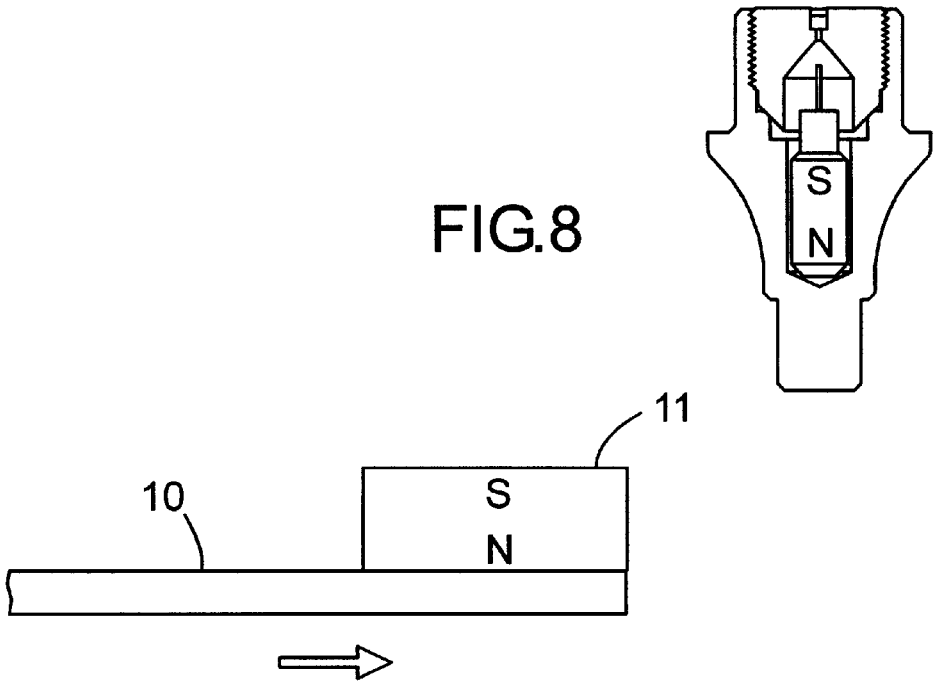
FIGS. 8–9 show schematically an operation sequence in a further arrangement of the invention and FIGS. 10 and 11 show schematically isometric sectionally views of the invention in other embodiments.
Figure 9:
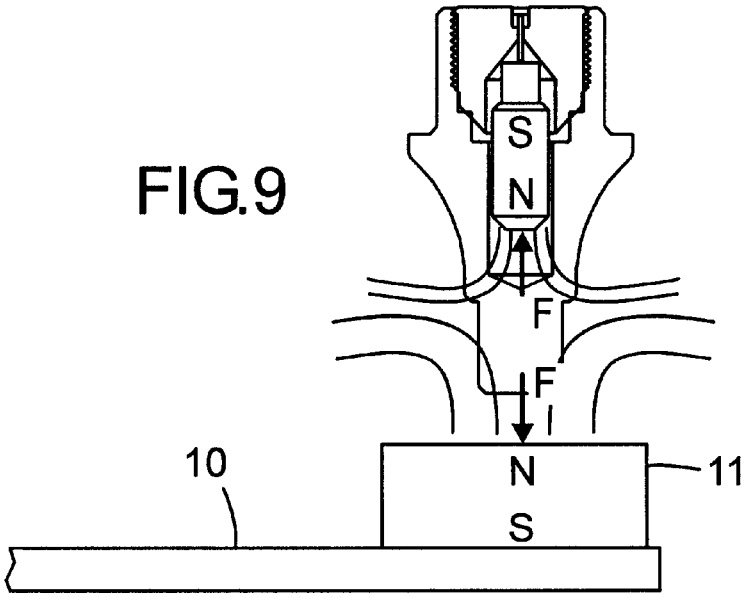
Figure 10:
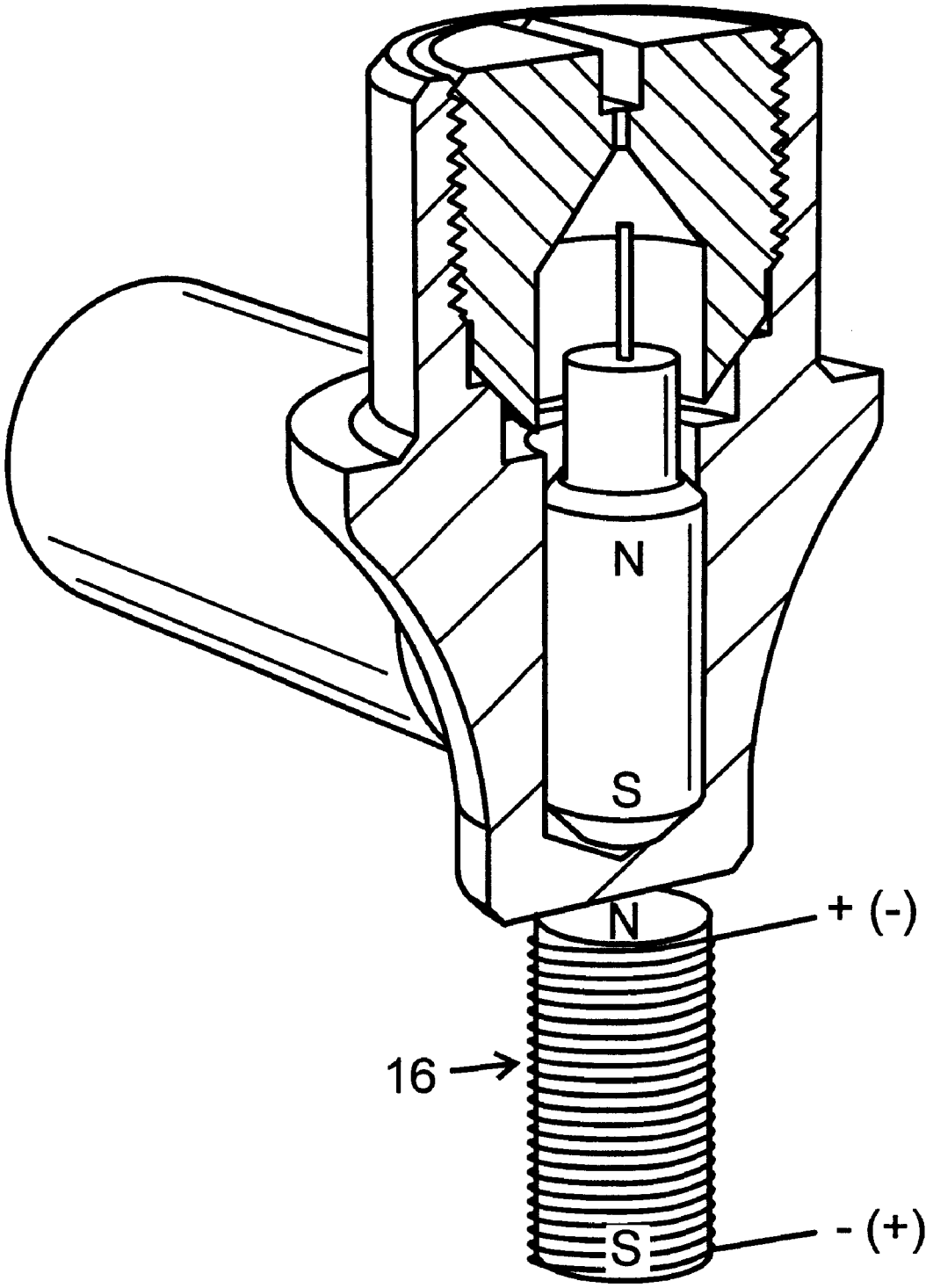

FIGS. 8 and 9 show the invention using only one magnet 11 on the slidable device 10. When displacing the device 10 with the magnet 11 its north pole N will be placed beneath the north pole N of the body 6, creating a repulse force (F). The difference compare to the arrangement according to FIGS. 3–7 is that the body 6 with the needle 7 will return to its lower position with the needle 7 out of the orifice 4 only by aid of gravity.

The needle 7 and needle body 6 in the housing 1 are mounted in a burner-head in a usual and known manner. A fuel line from the burner-head is connected to e.g. a fuel container, such as a fuel bottle. The fuel is a liquid or a gaseous fuel and could be white gas, diesel, kerosene etc. and LPG, butane, propane etc. respectively. The burner assembly should be mounted in a stove in a suitable manner, obvious to the man skilled in the art.

Figure 2:
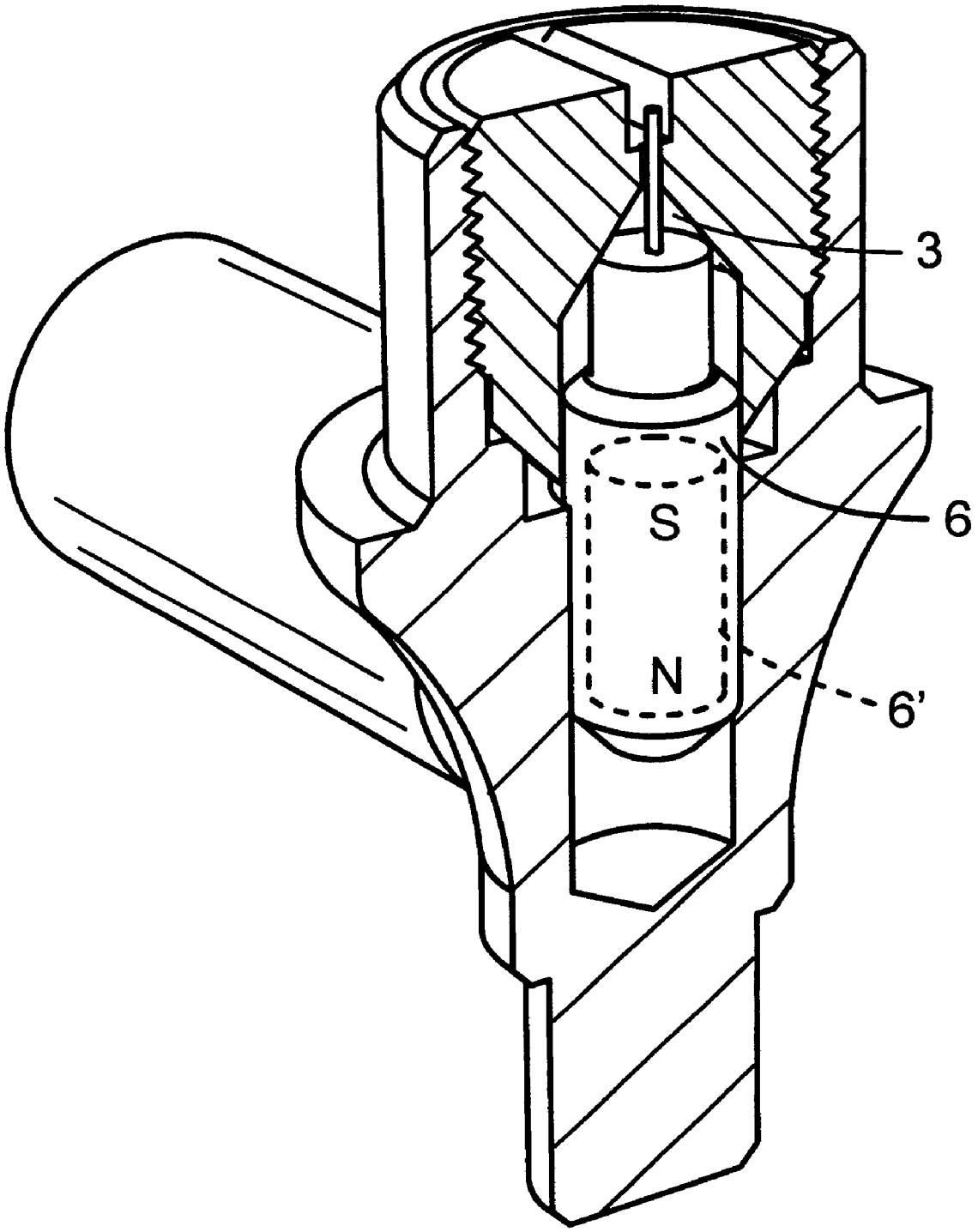

12 in FIGS. 1 and 2 depict a slot to be engaged by a screwdriver to dismount the nozzle section 2.

Instead of a separate permanent magnet it is also possible to use an electromagnetic magnet e.g. in the form of a solenoid 16, see FIG. 8. Mounting this beneath the housing 1 the body 6 with its needle 7 could be forced up and down in the housing 1 just by shifting the magnetic polarization of the solenoid.

Figure 11:
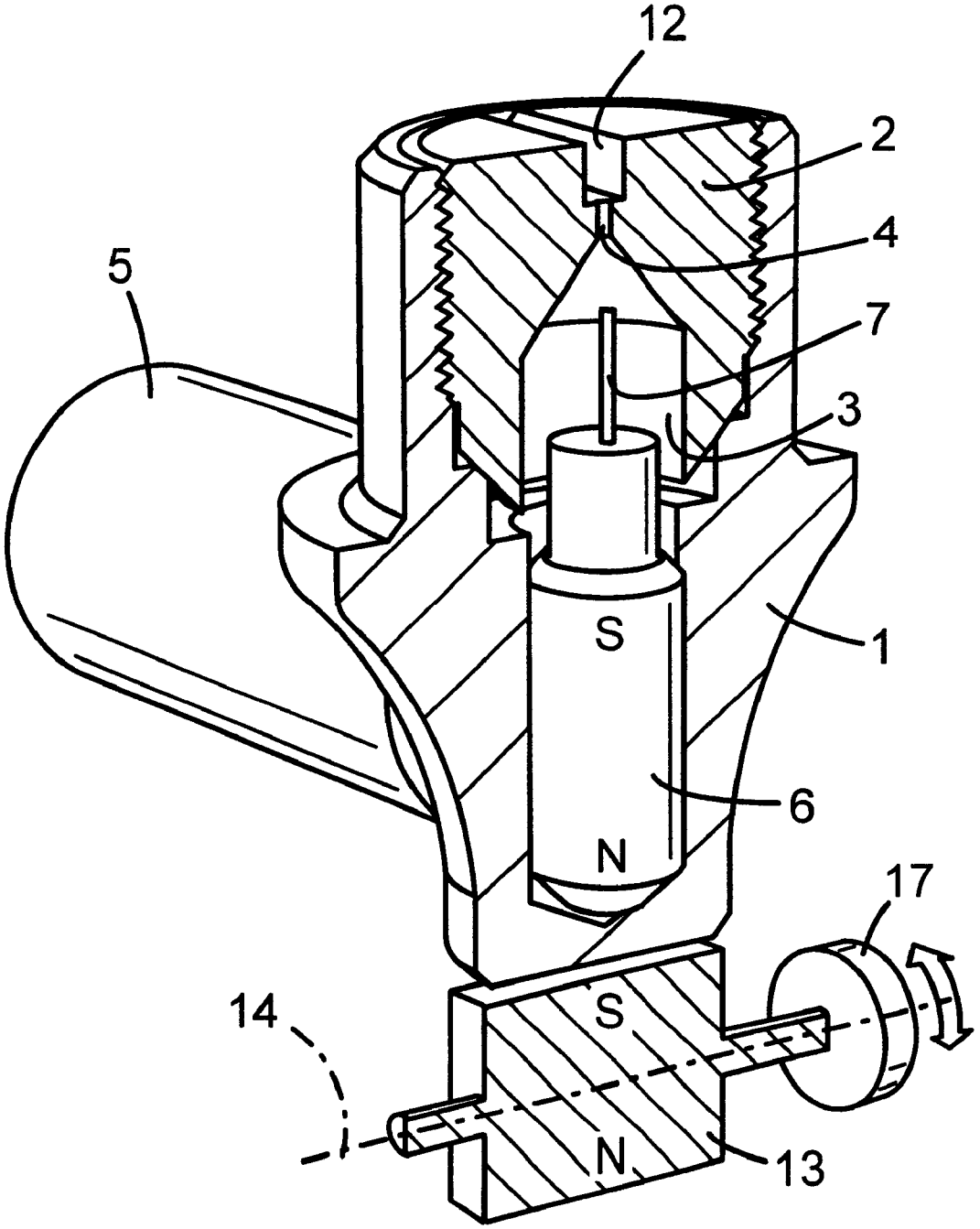

In the example shown in the FIG. 11 there is a separate permanent magnet 13 mounted beneath the burner assembly in line with the needle body 6. In the figure the south pole S of the permanent magnet 13 is adjacent the north pole N of the body 6 which means, that the poles attract each other and the body 6 with the needle 7 is retracted in the chamber 3, leaving the orifice 4 open. The separate permanent magnet 13 is rotable around the axis 14, schematically indicated, and in this configuration, when the poles are attracted to each other, the permanent magnet 13 will maintain this position. The permanent magnet 13 is rotated 180° by means of e.g. a knob (not indicated) which means, that the south pole S of the magnet 13 now will be turned to the position with its south pole S adjacent the south pole S of the body 6. This means that a repulse force is created between the magnet 13 and the body 6, which inturn means that the body 6 is forced upwardly, whereby the needle 7 penetrates the orifice 4. When the separate permanent magnet 13 is again rotated 180° the north pole N will now attrat the body 6 drawing the needle 7 out of the orifice 4. This rotation of the magnet 13 back to the former position could be effected due to the repulsion forces between the south poles of the magnet 13 and the body 6 or could be effected by rotating the knob.

It could be said that it is often necessary to be able to draw the needle out of the orifice by force because of that the needle often get stuck in the orifice and the weight of the body with the needle will not be sufficient to bring the needle out of the orifice. Suitable permanent magnets are of type neodynium-magnets. The mounting and manoeuvering of the magnets is per se quite obvious and is not an essential part of the invention.

It should be understood that instead of using a slidable device 10, a rotable device could be used provided with the magnets 8,9. Further, of course the chamber 3 and body 6 could have forms differing from the cylindrical form, e.g. square or triangular form.

What is claimed is:

1. In a burner assembly for burning of liquid or gaseous fuel having a housing including a nozzle orifice and containing a cleaning needle moveable into and out of the orifice, the improvement which comprises said needle having permanent magnetic characteristics and a first and a second permanent magnet mounted upon a moveable device capable of bringing the magnets one at a time beneath the housing and firstly when bringing the first magnet to pass beneath the housing the first magnet is attracting the needle and secondly when bringing the second magnet beneath the housing the second magnet is repelling the needle forcing this through the nozzle orifice.

2. In a burner assembly for burning of liquid or gaseous fuel having a housing including a nozzle orifice and containing a cleaning needle adapted for performing movements into and out of the orifice so as to clean the orifice, the improvement comprising said needle having permanent magnetic characteristics and permanent magnet means at a position beneath the housing for forcing said needle through the nozzle orifice.

3. The burner assembly according to claim 2, wherein said permanent magnet means includes a first and a second permanent magnet mounted upon a movable device capable of bringing the permanent magnets one at a time beneath the housing and firstly when bringing the first magnet to the position beneath the housing the first magnet is attracting the needle and secondly when bringing the second magnet to the position beneath the housing the second magnet is repelling the needle and forcing said needle through the nozzle orifice.

4. The burner assembly according to claim 2, wherein said permanent magnet means includes a single permanent magnet mounted upon a moveable device capable of bringing the permanent magnet to the position beneath the housing so as to force the needle through the nozzle orifice and capable of bringing the permanent magnet out of said position for causing the needle to move out of the nozzle orifice.

5. The burner assembly according to claim 2, wherein said permanent magnet means includes a permanent magnet rotatably mounted beneath said burner so as to rotate to a first angular position for creating a repulsive force to force the needle into said orifice and to a second position for causing the needle to move out of the nozzle orifice, and means for rotating the permanent magnet.

* * * * *